US009915900B1

(12) United States Patent
Eiki et al.

(10) Patent No.: US 9,915,900 B1
(45) Date of Patent: Mar. 13, 2018

(54) FIXING DEVICE AND IMAGE FORMING APPARATUS

(71) Applicant: KYOCERA Document Solutions Inc., Osaka (JP)

(72) Inventors: Takashi Eiki, Osaka (JP); Yoshihiro Yamagishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/654,811

(22) Filed: Jul. 20, 2017

(30) Foreign Application Priority Data

Aug. 26, 2016 (JP) ..... 2016-166110

(51) Int. Cl.
*G03G 15/20* (2006.01)

(52) U.S. Cl.
CPC ..... *G03G 15/2078* (2013.01); *G03G 15/2032* (2013.01); *G03G 15/2085* (2013.01); *G03G 2215/2016* (2013.01); *G03G 2215/2032* (2013.01); *G03G 2215/2041* (2013.01)

(58) Field of Classification Search
USPC ..... 399/107, 110, 122, 320, 328, 329; 219/216, 619
See application file for complete search history.

(56) References Cited

U.S. PATENT DOCUMENTS 7,233,764 B2 * 6/2007 Naito ..... G03G 15/2053 399/324
8,594,549 B2 * 11/2013 Shimokawa ..... G03G 15/2053 219/216
8,879,974 B2 * 11/2014 Ando ..... G03G 15/2057 399/329
9,152,106 B2 10/2015 Yamaguchi et al.
2014/0064804 A1 3/2014 Yamaguchi et al.

FOREIGN PATENT DOCUMENTS

JP 2014-048487 A 3/2014
JP 2014-145858 A 8/2014

* cited by examiner

*Primary Examiner* — Hoan Tran
(74) *Attorney, Agent, or Firm* — Studebaker & Brackett PC

(57) ABSTRACT

A fixing device includes a heating belt, a heat source, a pressuring body, a pressing member and a sheet member. The heating belt is endless and heats a medium while being circulated. The heat source supplies heat to the heating belt. The pressuring body forms a nip with the heating belt, rotates so as to circulate the heating belt and presses the medium with the heating belt. The pressing member is disposed inside the heating belt and presses the heating belt against the pressuring body at the nip. The sheet member is held between the heating belt and the pressing member, attached to the pressing member at a center side portion and both end side portions in a longitudinal direction of the sheet member and has a heat shrinkable property. The both end side portions are shiftable in the longitudinal direction greater than the center side portion.

6 Claims, 10 Drawing Sheets

FIG. 10

| sample | embodiment/ comparative embodiment | fitting ratio | | | result |
|---|---|---|---|---|---|
| | | most end | middle | center | |
| first sample | comparative embodiment | 1 | 1 | 1 | bad |
| second sample | embodiment | 1.15 | 1 | 1 | good |
| third sample | embodiment | 1.15 | 1.15 | 1 | good |
| fourth sample | embodiment | 1.3 | 1.2 | 1 | good |

FIXING DEVICE AND IMAGE FORMING APPARATUS

INCORPORATION BY REFERENCE

This application is based on and claims the benefit of priority from Japanese patent application No. 2016-166110 filed on Aug. 26, 2016, which is incorporated by reference in its entirety.

BACKGROUND

The present disclosure relates to a fixing device and an image forming apparatus.

An electrophotographic type image forming apparatus forms an image constituted by a toner on a medium and then fixes the image on the medium by a fixing device to form the image on the medium. As the fixing device included in the image forming apparatus, a fixing device including a fixing belt, a pressuring roller coming in pressure contact with the fixing belt, a nip forming member pressing the fixing belt toward the pressuring roller to forma nip and a sheet member fixed to the nip forming member and covering a fixing belt pressing portion of the nip forming member has been known.

SUMMARY

In accordance with an aspect of the present disclosure, a fixing device includes a heating belt, a heat source, a pressuring body, a pressing member and a sheet member. The heating belt is formed to be endless and heats a medium while being circulated. The heat source supplies heat for heating the medium to the heating belt. The pressuring body forms a nip with the heating belt, rotates around an axis so as to circulate the heating belt and presses the medium with the heating belt. The pressing member is disposed inside the heating belt and presses the heating belt against the pressuring body at the nip. The sheet member is held between the heating belt and the pressing member, attached to the pressing member at least at a center side portion and both end side portions in a longitudinal direction of the sheet member and has a heat shrinkable property. The both end side portions are shiftable in the longitudinal direction greater than the center side portion.

In accordance with an aspect of the present disclosure, an image forming apparatus includes the above fixing device and a forming part forming an image on the medium to be heated and pressed by the fixing device.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 10 is a table regarding an experiment carried out by using the fixing devices according to the embodiments (the first to the third embodiments) and a fixing device according to a comparative embodiment, and showing conditions of each fixing device and experimental results.

DETAILED DESCRIPTION

Overview

First, the present embodiment will be described. Next, modified embodiments of the present embodiment will be described.

The Present Embodiment

Hereinafter, an entire structure of an image forming apparatus 10 (refer to FIGS. 1 and 2) according to the present embodiment, an image forming operation carried out by the image forming apparatus 10, a structure of a fixing device 60 (refer to FIGS. 3, 4, 5, 6 and 7) which is a main element of the present embodiment and an effect of the present embodiment will be described with reference to the attached drawings in the described order. In the following description, directions shown by arrows Fr and Rr in each figure are respectively defined to be a front side and a rear side in a depth direction of the apparatus, directions shown by arrows R and L in each figure are respectively defined to be a right side and a left side in a width direction of the apparatus, and directions shown by arrows U and Lo in each figure are respectively defined to be an upper side and a lower side in a height direction of the apparatus.

Entire Structure of the Image Forming Apparatus

Figure 1:
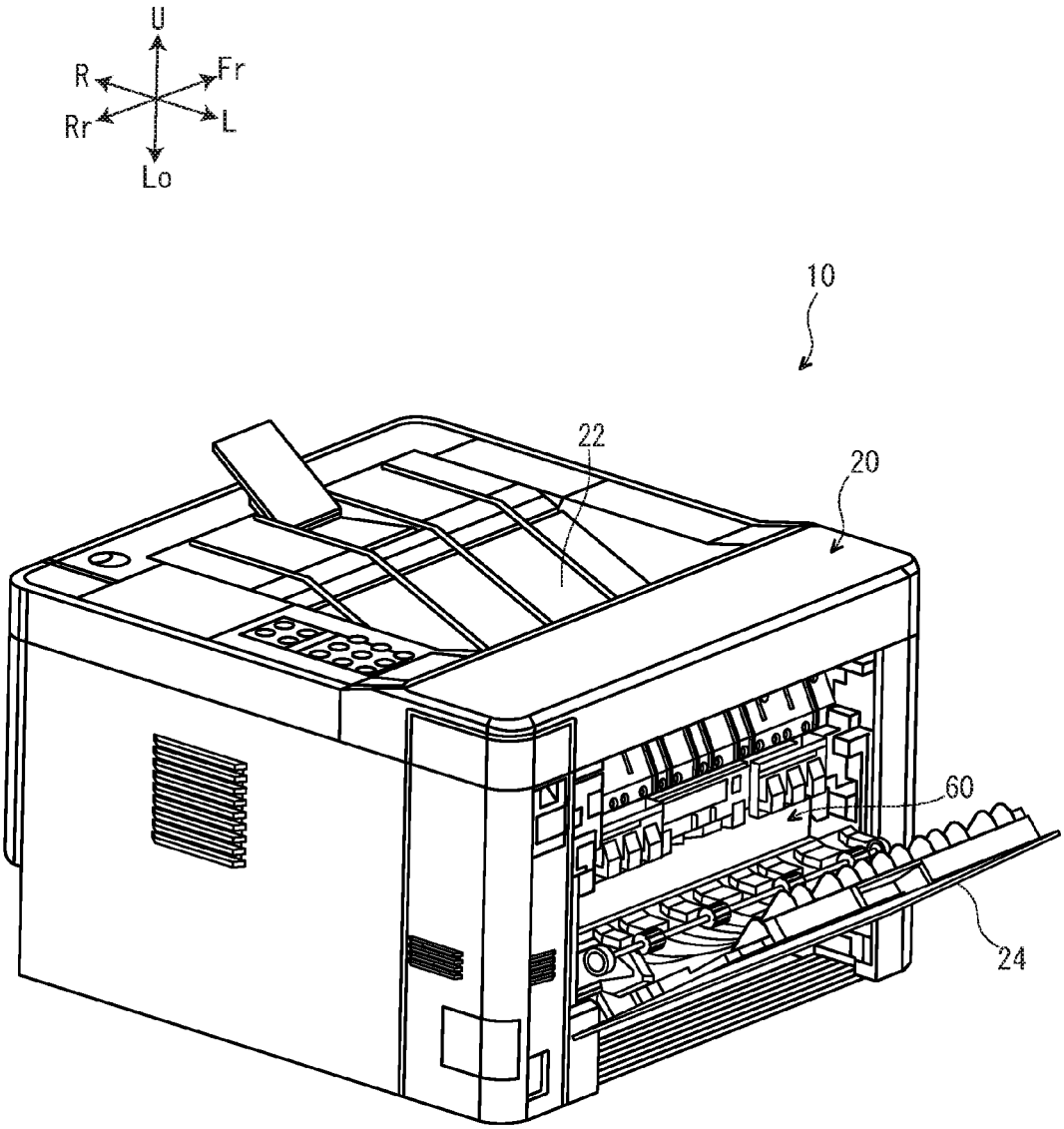
FIG. 1 is a perspective view showing an image forming apparatus according to an embodiment for carrying out the present disclosure (hereinafter, referred to as the present embodiment).
Figure 2:
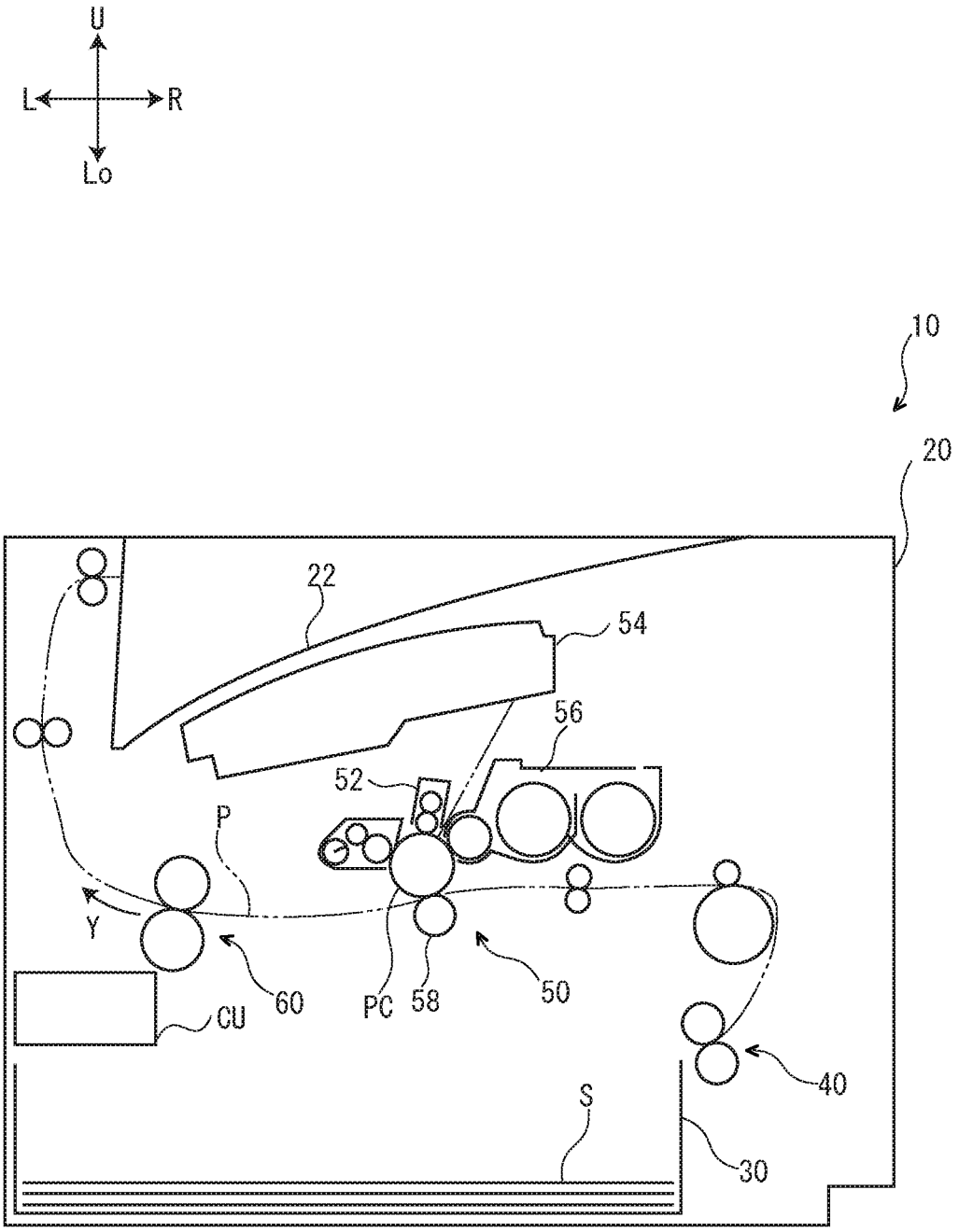
FIG. 2 is a schematic view showing the image forming apparatus according to the present embodiment when viewed from a front side.

With reference to FIGS. 1 and 2, the entire structure of the image forming apparatus 10 will be described. The image forming apparatus 10 is an electrophotographic type apparatus including a main body 20, a sheet feeding cassette 30, a conveying device 40, a toner image forming part 50 (an example of a forming part), a fixing device 60 and a control part CU. The image forming apparatus 10 of the present embodiment is a printer, for example.

The main body 20 is formed to be a box-shaped exterior body in which the sheet feeding cassette 30, the conveying device 40, the toner image forming part 50, the fixing device 60 and the control part CU are stored. A part of an upper face of the main body 20 is an ejection tray 22 on which a medium S having a fixed toner image (an example of an image) is ejected. When viewed from the front side in the depth direction of the apparatus, the main body 20 has an openable and closable lid 24 on the left side face. The sheet feeding cassette 30 is disposed in a lower portion of an inside of the main body 20. The conveying device 40 includes a plurality of rollers and is configured to convey the medium S from the sheet feeding cassette 30 to the ejection tray 22 in a direction shown by an arrow Y along a conveying path P. That is, the direction of the arrow Y shows a conveying direction of the medium S.

The toner image forming part 50 is disposed in a center portion and an upper portion of the inside of the main body 20 when viewed from the front side in the depth direction of the apparatus. The toner image forming part 50 includes a photosensitive drum PC, a charging device 52, an exposing device 54, a developing device 56 and a transferring roller 58. The charging device 52 charges the photosensitive drum PC which is rotated around an axis by a driving source (not shown), the exposing device 54 exposes the photosensitive drum PC to form an electrostatic latent image, the developing device 56 develops the electrostatic latent image to a toner image and the transferring roller 58 transfers the toner image to the medium S conveyed along the conveying path P by the conveying device 40. That is, the toner image forming part 50 is configured to form the toner image on the medium S.

The fixing device 60 is disposed on a downstream side of the toner image transferring position by the toner image forming part 50 on the conveying path P. The fixing device 60 is configured to heat and press the medium S on which the toner image has been formed and to fix the toner image on the medium. S. The fixing device 60 is configured to be attachable to and detachable from the main body 20. Under a state where the lid 24 is titled, the fixing device 60 is attachable to and detachable from the main body 20 (refer to FIG. 1).

The control part CU is disposed at a lower and left side portion of the inside of the main body 20 when viewed from the front side in the depth direction of the apparatus. The control part CU is configured to receive an image data from an external device (not shown) and to control each component included in the image forming apparatus 10 based on the received image data.

Image Forming Operation

Next, an image forming operation carried out by using the image forming apparatus 10 according to the present embodiment will be described with reference to FIG. 2.

First, the control part CU operates the toner image forming part 50 after receiving the image data from the external device (not shown). The control part CU also operates the fixing device 60. Then, the charging device 52 charges the photosensitive drum PC, the exposing device 54 exposes the photosensitive drum PC to form an electrostatic latent image and then the developing device 56 develops the electrostatic latent image to a toner image to form the toner image on the photosensitive drum PC.

The control part CU operates the conveying device 40 so as to feed the medium S to the transferring position synchronously with timing when the toner image formed on the photosensitive drum PC arrives at the transferring position by the rotation of the photosensitive drum PC around the axis. Then, the control part CU controls the transferring roller 58 so as to transfer the toner image formed on the photosensitive drum PC on the medium S.

Next, the fixing device 60 heats and presses the toner image transferred on the medium S by the transferring roller 58 to fix the toner image on the medium S. Then, the medium S on which the toner image has been fixed is ejected on the ejection tray 22 of the main body 20 by the conveying device 40. Then, the image forming operation is completed.

Configuration of Main Element (the Fixing Device)

Next, a configuration of the fixing device 60 that is the main element of the present embodiment will be described in detail with reference to FIGS. 3, 4, 5 and 6.

Figure 3:
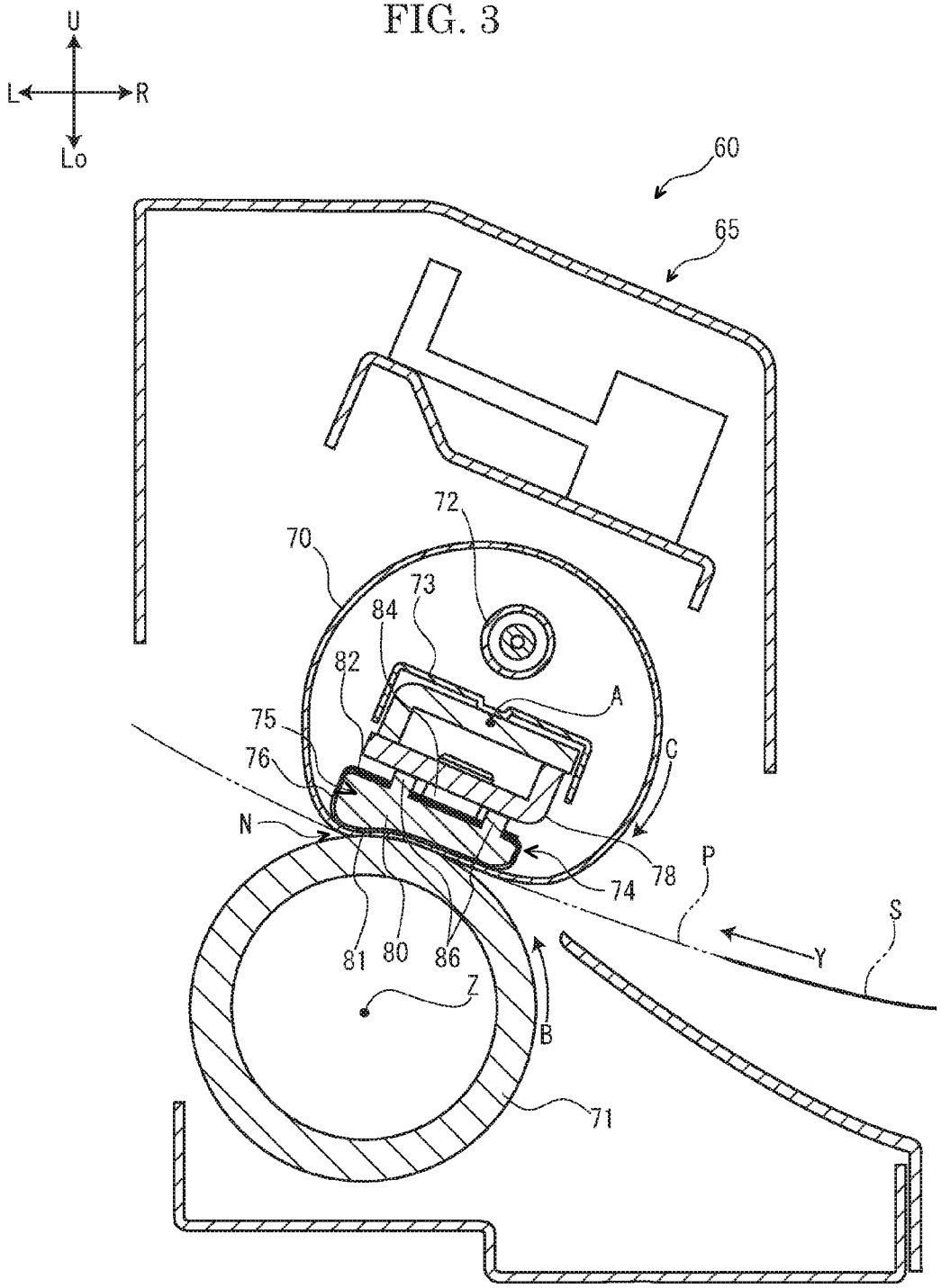
FIG. 3 is a sectional view showing a fixing device included in the image forming apparatus according to the present embodiment when the fixing device is cut at a center in a depth direction of the apparatus.

As shown in FIG. 3, the fixing device 60 includes a main body 65, a heating belt 70, a pressuring roller 71 (an example of a pressuring body), a heat source 72, a reflection member 73, a pressing part 74, a supporting member 78 and a pair of side plates (not shown). Here, the main body 65, the heating belt 70, the pressuring roller 71, the heat source 72, the reflection member 73 and the pressing part 74 are each made to be an elongated shape and disposed with their longitudinal directions being along the same direction (the depth direction of the apparatus). The fixing device 60 is made to be an elongated shape and attached to the main body 20 of the image forming apparatus 10 in a state where its longitudinal direction is along the depth direction of the apparatus (refer to FIG.

Main Body

As shown in FIG. 3, the main body 65 is formed into a box-shaped exterior body in which the heating belt 70, the pressuring roller 71, the heat source 72, the reflection member 73, the pressing part 74 and the pair of side plates are stored. The pair of side plates are oppositely disposed at both end sides in the longitudinal direction of the main body 65. To the pair of side plates, the heating belt 70, the pressuring roller 71, the heat source 72 and the supporting member 78 are positioned.

Heating Belt

The heating belt 70 has a function of heating the toner image (the toner forming the toner image) formed on the medium S by the toner image forming part 50 and the medium S. The heating belt 70 is formed to be endless, as shown in FIG. 3. The heating belt 70 is configured to be circulated (at a constant rate) when driven by the pressuring roller 71, as described later, while being heated by absorbing light radiated from the heat source 72, as described later. An axis A in FIG. 3 shows an axis (a rotation center) of the heating belt 70, and an arrow C shows a direction in which the heating belt 70 is circulated. The heating belt 70 is configured to press the medium S having the toner image and conveyed by the conveying device 40, together with the pressuring roller 71 at the nip, as described later. As a result, the heating belt 70 is configured to fix the toner image on the medium S passing through the nip N, together with the pressuring roller 71. The heating belt 70 is configured to heat the medium S in a state where both ends in a width direction (a direction perpendicular to the conveying direction Y) of the medium S conveyed by the conveying device 40 are positioned inside both ends of the heating belt 70 in the width direction. Additionally, as shown in FIG. 3, the heating belt 70 is disposed at a center side of an inside of the main body 65 when viewed in the depth direction of the apparatus (near a center in the width direction and the height direction).

Into the both ends of the heating belt 70, flanges (not shown) are fitted. The heating belt 70 is fixed to the flanges by adhesion. The flanges are rotatably supported by the pair of side plates. As shown in FIG. 3, inside the heating belt 70, the heat source 72, the reflection member 73, the pressing part 74 and the supporting member 78 are disposed.

Pressuring Roller

The pressuring roller 71 has a function of pressuring the toner image (the toner constituting the toner image) formed on the medium S by the toner image forming part 50 and the medium S, together with the heating belt 70. The pressuring roller 71 is formed into a roller including a long shaft and a coating layer (for example, a silicon rubber layer) coating an outer circumference of the shaft. As shown in FIG. 3, the pressuring roller 71 is disposed below the heating belt 70 when viewed in the depth direction of the apparatus. With an upper portion of the pressuring roller 71, a lower portion of the heating belt 70 comes in contact in a state where the lower portion is recessed upward along an outer circumference of the pressuring roller 71. The above described nip N means a contact portion between the pressuring roller 71 and the heating belt 70 formed by the pressuring roller 71 and the heating belt 70.

To one end of the shaft of the pressuring roller 71, a drive source (not shown) is coupled. The pressuring roller 71 is driven by the drive source to be rotated around an axis Z and to circulate the heating belt 70. The arrow B in FIG. 3 shows a rotation direction of the pressuring roller 71.

Heat Source

The heat source 72 has a function of irradiating a part in a circumferential direction of the heating belt 70 within a range from one end to the other end of the heating belt 70 with light for heating the heating belt 70. The heat source 72 is a halogen heater, for example. As shown in FIG. 3, the heat source 72 is disposed inside the heating belt 70 and above the axis A when viewed in the depth direction of the apparatus. As a result, the heat source 72 is configured to supply heat for heating the medium S to the heating belt 70 which is circulated. The heat source 72 is configured to irradiate an entire area in the width direction of the heating belt 70 with the light. That is, in the present embodiment, the entire area in the width direction of the heating belt 70 is heated by the light radiated from the heat source 72.

Reflection Member

The reflection member 73 is formed into an elongated shape having a U-shaped cross section (that is, a shape whose one side is open). As shown in FIG. 3, the reflection member 73 is disposed at a center side of the inside of the heating belt 70 (near a center in the width direction and the height direction) below the heat source 72 in a state where its opened side faces downward and its longitudinal direction is along the longitudinal direction of the heating belt 70 when viewed in the depth direction of the apparatus. The reflection member 73 is configured to reflect the light radiated from the heat source 72 and entered therein to an inner circumference of an upper portion of the heating belt 70.

Pressing Part

Figure 4:
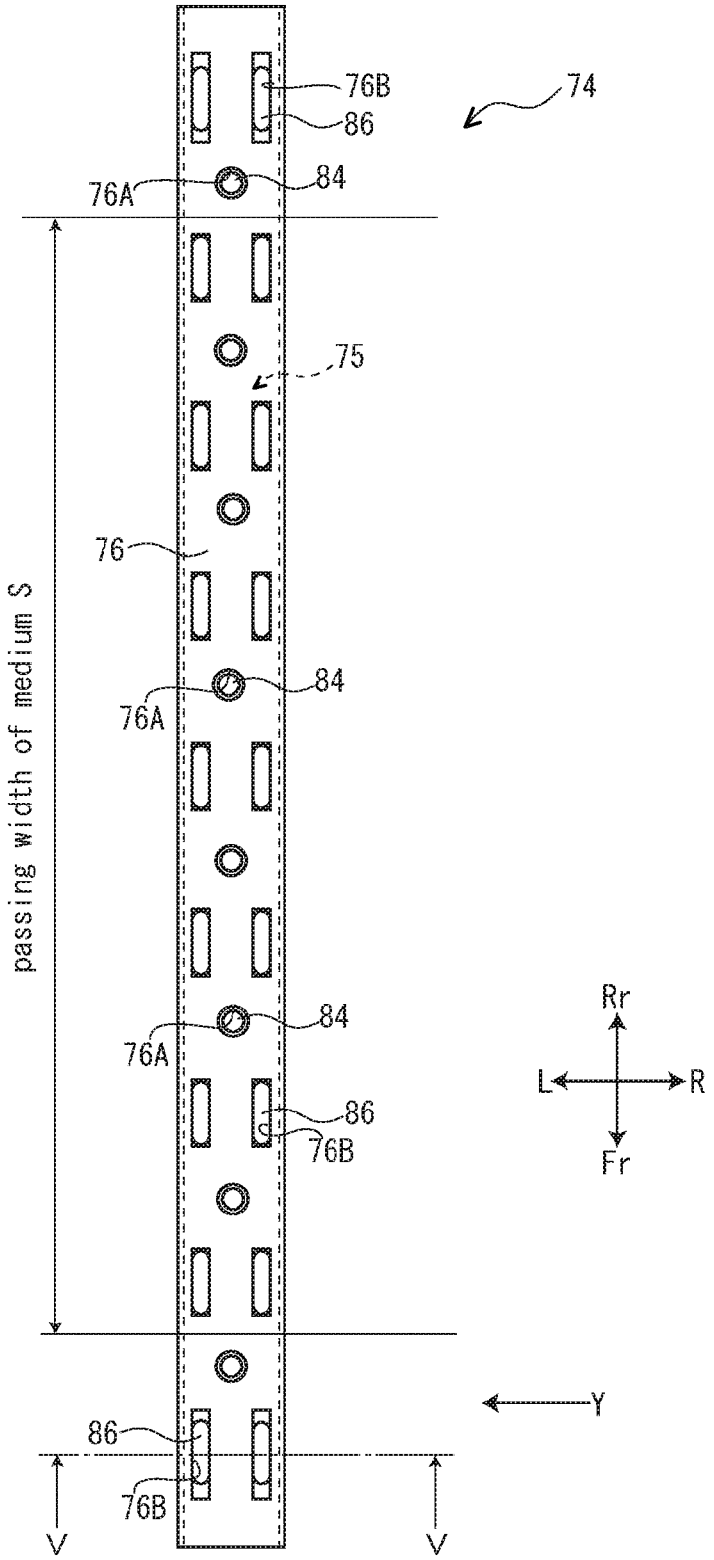
FIG. 4 is a view showing a pressing part according to the present embodiment when viewed from an upper side.
Figure 5:
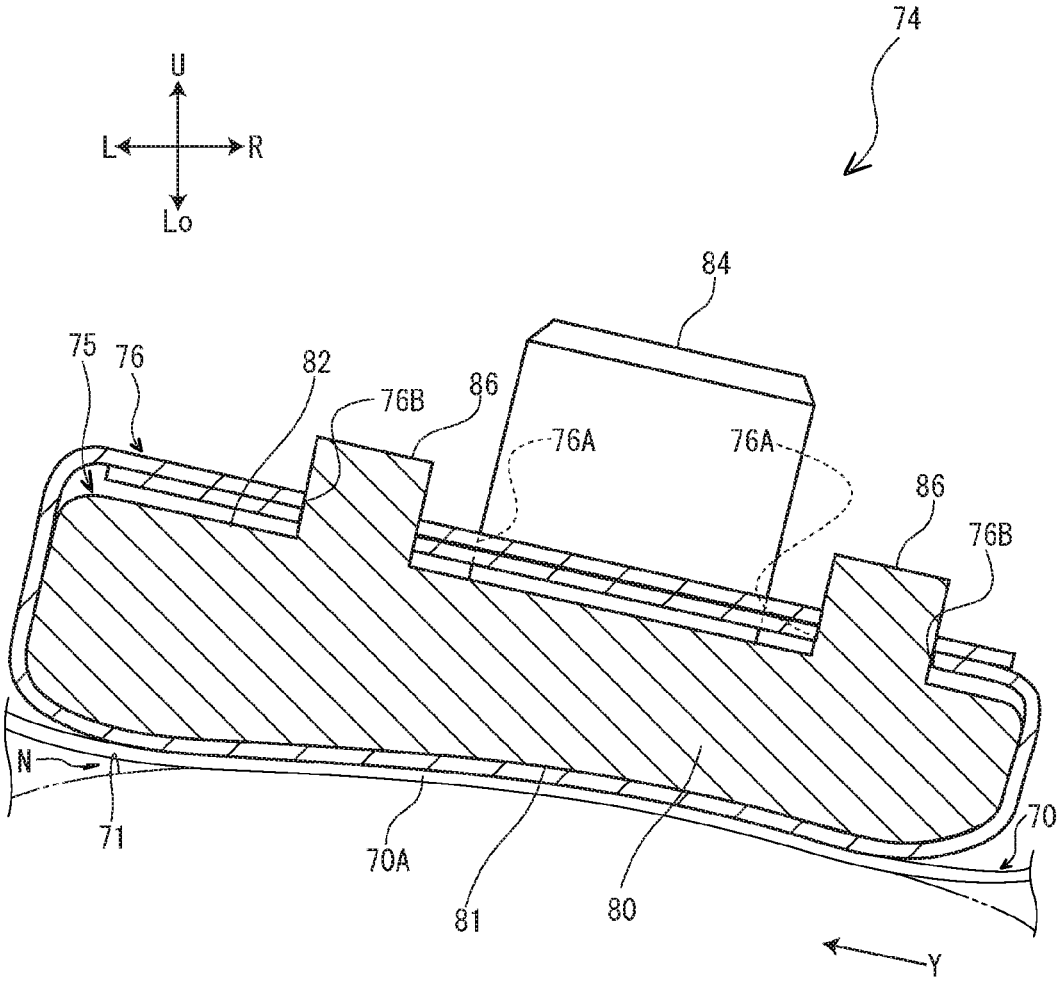
FIG. 5 is a sectional view taken along a line V-V of FIG. 4.

As shown in FIG. 3, the pressing part 74 is disposed inside the heating belt 70 and below the axis A (and the reflection member 73) when viewed in the depth direction of the apparatus. As shown in FIGS. 3, 4 and 5, the pressing part 74 includes a pressing member 75 and a sheet member 76.

Pressing Member

The pressing member 75 has a function of pressing the heating belt 70 against the pressuring roller 71 to form the nip N. Hereinafter, a part pressed against the pressuring roller 71 in order to form the nip N is called as a forming portion 70A of the heating belt 70. As shown in FIGS. 3, 4 and 5, the pressing member 75 has a main body 80, a plurality of pins 84 and a plurality of projections 86. A material of the pressing member 75 is a heat resistant resin, such as a liquid crystal polymer (LCP), for example.

As shown in FIGS. 3, 4 and 5, the main body 80 is formed into an elongated shape having a rectangular cross section. As shown in FIGS. 3 and 5, a face on a lower side of the main body 80 is recessed in a curved shape when viewed in the depth direction of the apparatus. In the following description, the face on the curved recessed lower side of the main body 80 is defined as a lower face 81 and a face on an upper side (a face opposite to the lower face 81) is defined as an upper face 82.

The plurality of pins 84 protrude upward from the upper face 82. As shown in FIG. 4, the plurality of pins 84 are disposed at a center in a lateral direction of the main body 80 and arranged at predetermined intervals (constant intervals, for example) from one end to the other end in a longitudinal direction of the main body 80. The plurality of pins 84 are formed in order for the pressing part 74 to be supported by the supporting member 78 (refer to FIG. 3).

As shown in FIGS. 3 and 5, the plurality of projections 86 protrude upward from the upper face 82 in a state where they are arranged on both sides across the plurality of pins 84 in the lateral direction of the main body 80 when viewed in the depth direction of the apparatus. As shown in FIG. 4, the plurality of projections 86 are arranged at predetermined intervals (constant intervals, for example) from one end to the other end in the longitudinal direction of the main body 80. That is, the plurality of projections 86 are formed at least at a center side portion and both end side portions in the longitudinal direction of a portion (the upper face 82, for example) other than the lower face 81 of the pressing member 75 (a portion which presses the forming portion 70A against the pressuring roller 71). As shown in FIG. 4, each of the plurality of projections 86 is formed into a rectangular shape when viewed from a side of the upper face 82. A longitudinal direction of each projection 86 is along the longitudinal direction of the main body 80. The plurality of projections 86 are formed in order to fix the sheet member 76 to the main body 80 (or the pressing member 75) (refer to FIGS. 3, 4 and 5). Of the plurality of projections 86, the projections 86 on both ends in the longitudinal direction of the main body 80 are arranged outside both ends in a width direction (a direction perpendicular to the conveying direction Y) of the medium S conveyed by the conveying device 40.

Sheet Member

The sheet member 76 is disposed while held by (between) the forming portion 70A and the pressing member 75 and has a function of reducing a load received by being pressed compared with a case where the pressing member 75 is made to directly come in contact with the forming portion 70A. A material of the sheet member 76 is a fluorine-based resin, such as PTFE, for example. That is, the sheet member 76 has a heat shrinkable property. The sheet member 76 has a coefficient of friction smaller than that of the pressing member 75. In the present embodiment, the heating belt 70 is accordingly made to be easily slid at the nip N (the forming portion 70A) compared with a case where the pressing member 75 directly comes into contact with the heating belt 70. Because the heating belt 70 is driven by the pressuring roller 71 to be circulated, the sheet member 76 has a coefficient of friction smaller than that of the coating layer of the pressuring roller 71.

As shown in FIGS. 3, 4 and 5, the sheet member 76 is formed into an elongated shape and (a part thereof) held between the forming portion 70A and the pressing member 75 with its longitudinal direction being along the longitudinal direction of the pressing member 75 (or the depth direction of the apparatus). In other words, as shown in FIGS. 3 and 5, the sheet member 76 covers the lower face 81 of the pressing member 75. As shown in FIG. 5, both side portions in the lateral direction of the sheet member 76 extend from both ends (each end) in the lateral direction of the lower face 81 of the pressing member 75, and are fixed to the pressing member 75 in a state where they overlap with each other at the upper face 82.

Figure 6:
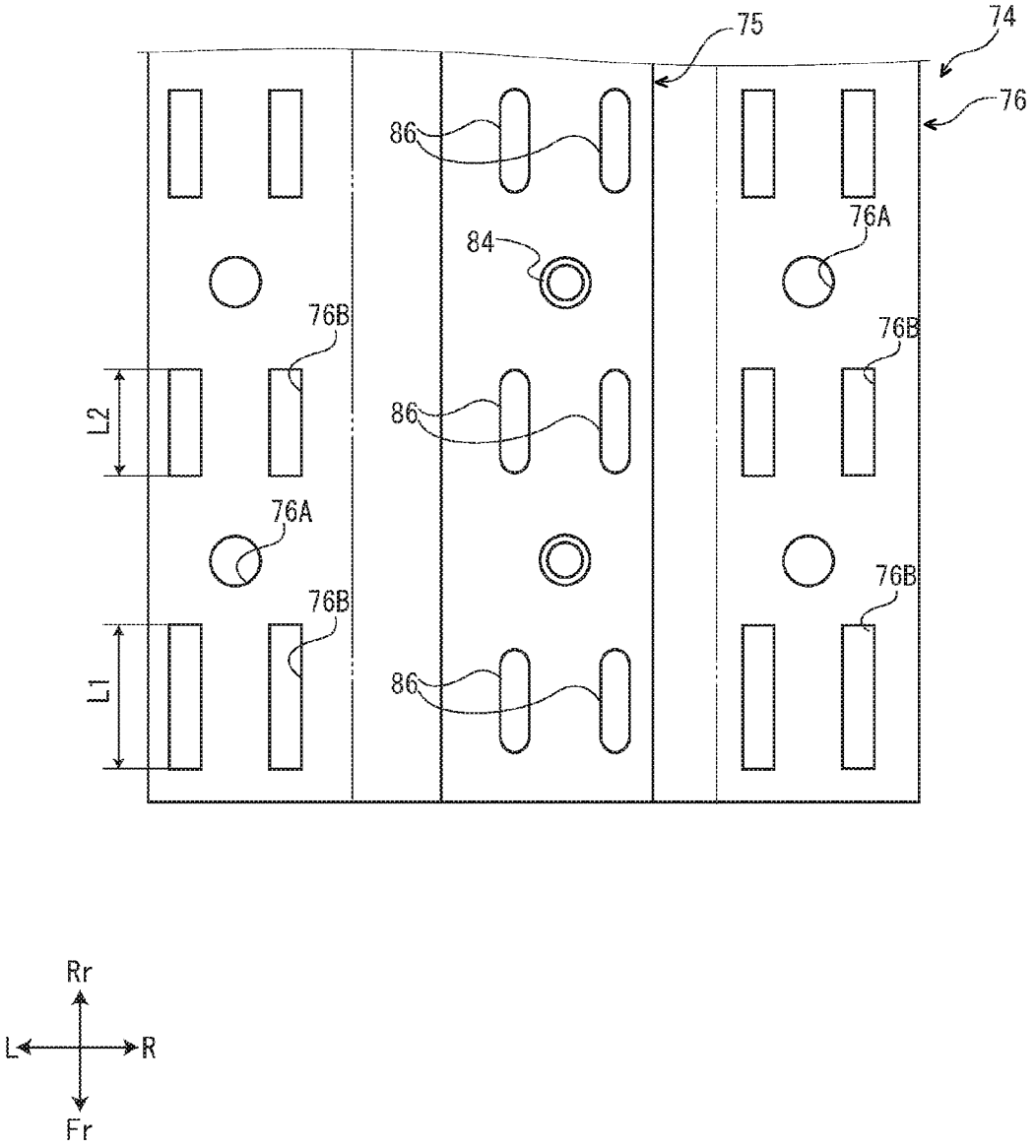
FIG. 6 is a view schematically showing the pressing part according to the present embodiment when viewed from the upper side in a state where a sheet member is disposed in natural condition with the sheet member coming into contact with a lower face of a pressing member.

As shown in FIG. 6, the sheet member 76 has a plurality of through holes 76A and a plurality of through holes 76B. The plurality of through holes 76A are arranged along the longitudinal direction in the both side portions in the lateral direction of the sheet member 76 in a state where the sheet member 76 alone is placed on a flat plane. The plurality of through holes 76B are arranged along the longitudinal direction on both sides across the plurality of through holes 76A arranged in the both side portions in the above state. Each of the through holes 76A is formed into a circular hole, for example, and each of the through holes 76B is formed into a rectangular hole, for example.

As shown in FIGS. 4 and 5, in a state where the sheet member 76 forms the pressing part 74 together with the pressing member 75, the both side portions in the lateral direction of the sheet member 76 overlap with each other at on the upper face 82 of the pressing member 75, and the plurality of pins 84 of the pressing member 75 penetrate the plurality of through holes 76A and the plurality of projections 86 of the pressing member 75 are fitted into the plurality of through holes 76B. In other words, the plurality of through holes 76B are formed along the longitudinal direction at both end side portions and a center side portion in the longitudinal direction of the sheet member 76 such that the plurality of projections 86 of the pressing member 75 are capable of being fitted therein. The sheet member 76 is attached to the pressing member 75 at least at the center side portion and the both end side portions in the longitudinal direction in a portion other than the portion held between the forming portion 70A and the pressing member 75.

Of the plurality of through holes 76B, the through holes 76B on both most ends in the longitudinal direction of the sheet member 76 have a length L1 in the longitudinal direction longer than a length L2 in the longitudinal direction of the through holes 76B other than the through holes 76B on the both most ends in the longitudinal direction of the sheet member 76. Thus, of the plurality of through holes 76B, the through holes 76B on the both most ends of the sheet member 76 (that is, the through holes 76B on the both end side portions) have a clearance in the longitudinal direction with respect to the projections 86 larger than the through holes 76B other than the through holes 76B on the both most ends of the sheet member 76B (that is, the through holes 76B on the center side portion) (hereinafter, the above described relationship between the through hole and the projection is called as the relationship of the clearance in the sheet member 76 of the present embodiment). As a result, the sheet member 76 is attached to the pressing member 75 in a state where it is hardly caught by the most end projections 86 of the pressing member 75 when the sheet member 76 is heated by the heat of the heating belt 70 at the fixing operation and then shrunk. In other words, the sheet member 76 is attached to the pressing member 75 in a state where the both end side portions in the longitudinal direction of the sheet member 76 are shiftable in the longitudinal direction greater than the center side portion.

Supporting Member

The supporting member 78 is formed into an elongated shape. As shown in FIG. 3, the supporting member 78 is formed by facing a pair of elongated L-shaped metal plates alternately so as to have a rectangular cross-section. As shown in FIG. 3, the supporting member 78 is disposed below the reflection member 73 and above the pressing member 75 when viewed in the depth direction of the apparatus. The supporting member 78 supports the reflection member 73 and the pressing member 75. With a lower face of the supporting member 78, tip end portions (upper end portions) of the plurality of projections 86 of the pressing member 75 come into contact. The supporting member 78 supports the pressing part 74 by fitting the plurality of pins 84 of the pressing member 75 into a plurality of through holes formed on the lower face thereof.

Effect

Next, an effect of the present embodiment will be described with reference to the corresponding figures.

In a case where the pressing part 74 does not have the relationship of the clearance in the sheet member 76 of the present embodiment, for example, in a case where each of the through holes 76B on the most ends in the longitudinal direction of the sheet member 76 has the length L2 and there is almost no clearance between each through hole 76B and each projection 86 fitted into each through hole 76B (hereinafter, referred to as a comparative embodiment), when the fixing operation is carried out, the following problem may be occurred. In the comparative embodiment, at the fixing operation, heat of a contact portion of the heating belt 70 with the medium S when the medium S is passed through the nip N is taken away by the medium S. On the contrary, heat of a non-contact portion of the heating belt 70 with the medium S when the medium S is passed through the nip N (that is, the both end side portions in the longitudinal direction of the heating belt 70) is hardly taken away by the medium S. Thus, a larger amount of heat is taken away by the medium S from an overlapped portion of the sheet member 76 with a passing area of the medium S (the center side portion in the longitudinal direction of the sheet member 76) than a non-overlapped portion of the sheet member 76 with the passing area of the medium S (the both end side portions in the longitudinal direction of the sheet member 76). In other words, the both end side portions in the longitudinal direction of the sheet member 76 is heated faster than the center side portion. As the fixing operation is continuously carried out for a long period, a difference in temperature between the both end side portions and the center side portion of the sheet member 76 becomes large. Thus, in the comparative embodiment, the both end side portions in the longitudinal direction of the sheet member 76 is shrunk larger than the center side portion owing to the temperature difference described above. As a result, the both end side portions in the longitudinal direction of the sheet member 76 may be pulled in the longitudinal direction and then teared.

On the contrary, the pressing part 74 of the present embodiment has the above described relationship of the clearance in the sheet member 76 of the present embodiment (refer to FIG. 4). In other words, the sheet member 76 is attached to the pressing member 75 in the state where the both end side portions in the longitudinal direction of the sheet member 76 are shiftable in the longitudinal direction greater than the center side portion.

Accordingly, in the fixing device 60 according to the present embodiment, if the both end side portions of the sheet member 76 may be shrunk, the sheet member 76 is easily shifted in the longitudinal direction. As a result, in the fixing device 60 according to the present embodiment, when the both end side portions of the sheet member 76 are shrunk, the sheet member 76 is hardly teared. Thereby, the fixing device 60 (and the image forming apparatus 10) according to the present embodiment has a long product life.

Modified Embodiments

Next, modified embodiments (a first to a third modified embodiments) of the present embodiment will be described with reference to the corresponding figures. Hereinafter, different portions from the present embodiment (or the above described examples) will be described in each modified embodiment.

First Modified Embodiment

Figure 7:
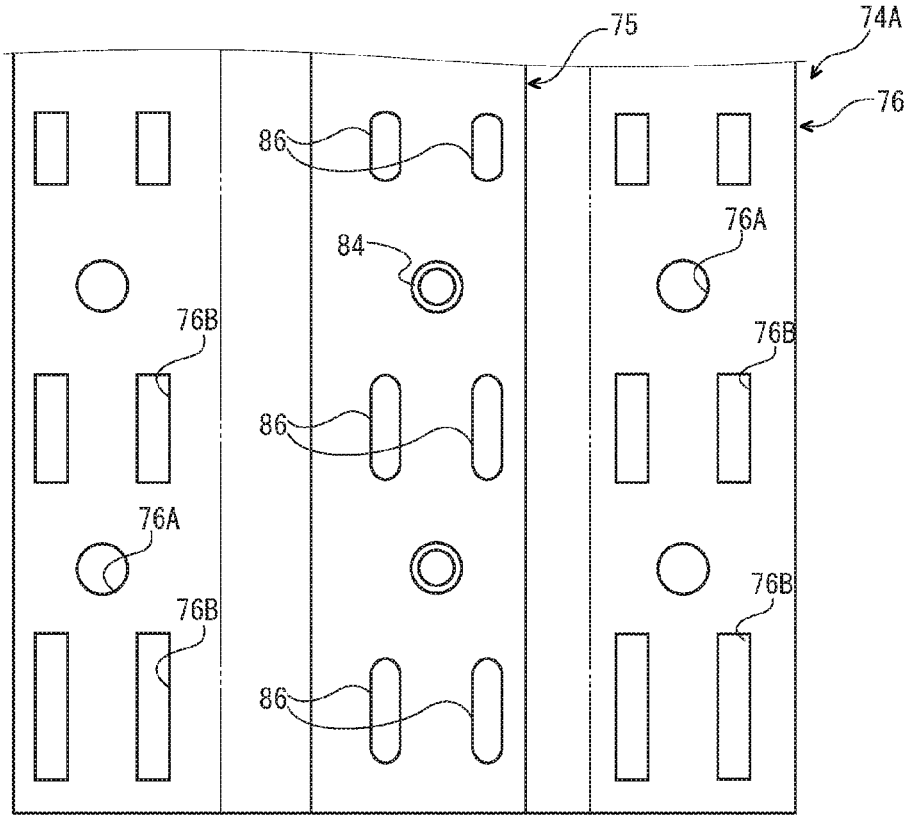
FIG. 7 is a view schematically showing the pressing part according to a first modified embodiment when viewed from the upper side in a state where the sheet member is disposed in natural condition with the sheet member coming into contact with the lower face of the pressing member.
Figure 7:
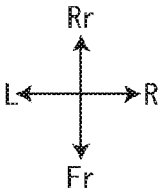

The pressing part 74A of the first modified embodiment is different from the pressing part 74 of the present embodiment in the following point. As shown in FIG. 7, in the pressing part 74A of the first modified embodiment, the length in the longitudinal direction of the through hole 76B is gradually increased from a center to both ends in the longitudinal direction of the pressing part 74A, that is, a clearance of each through hole 76B with respect to each projection 86 is gradually increased from the center to the both ends in the longitudinal direction.

The first modified embodiment exhibits the excellent effect of the present embodiment when the mediums S having different widths are fixed because it corresponds to the medium S of each width, compared with the present embodiment. The other effect of the first modified embodiment are the same as the present embodiment.

Second Modified Embodiment

Figure 8:
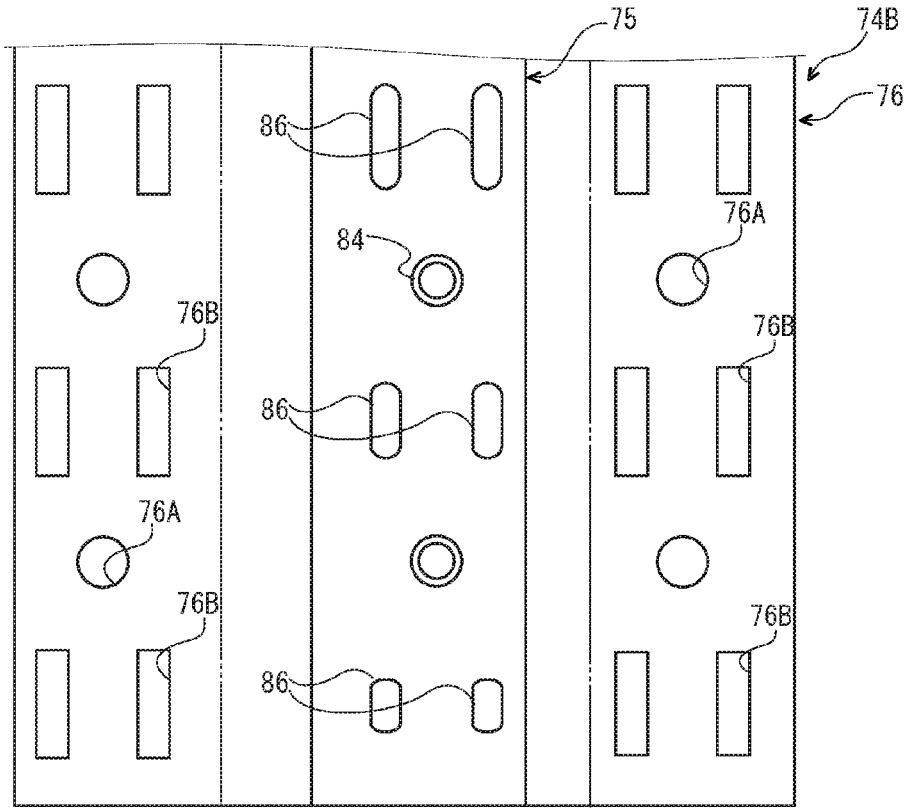
FIG. 8 is a view schematically showing the pressing part according to a second modified embodiment when viewed from the upper side in a state where the sheet member is disposed in natural condition with the sheet member coming into contact with the lower face of the pressing member.
Figure 8:
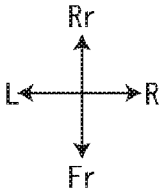

The pressing part 74B of the second modified embodiment is different from the pressing part 74 of the present embodiment in the following point. As shown in FIG. 8, in the pressing part 74B of the second modified embodiment, the length in the longitudinal direction of each projection 86 is gradually decreased from the center to the both ends in the longitudinal direction of the pressing part 74B with the length in the longitudinal direction of each through hole 76B kept constant. That is, in the second modified embodiment, the length in the longitudinal direction of each projection 86 fitted into each through hole 76B formed on the both end side portions of the sheet member 76 is shorter than the length in the longitudinal direction of each projection 86 fitted into each through hole 76B formed on the center side portion of the sheet member 76. In the pressing part 74B according to the second modified embodiment, the clearance of each through hole 76B with respect to each projection 86 is gradually increased from the center to the both ends in the longitudinal direction of the pressing part 74B, as well as the first modified embodiment.

An effect of the second modified embodiment is the same as that of the first modified embodiment.

Third Modified Embodiment

Figure 9:
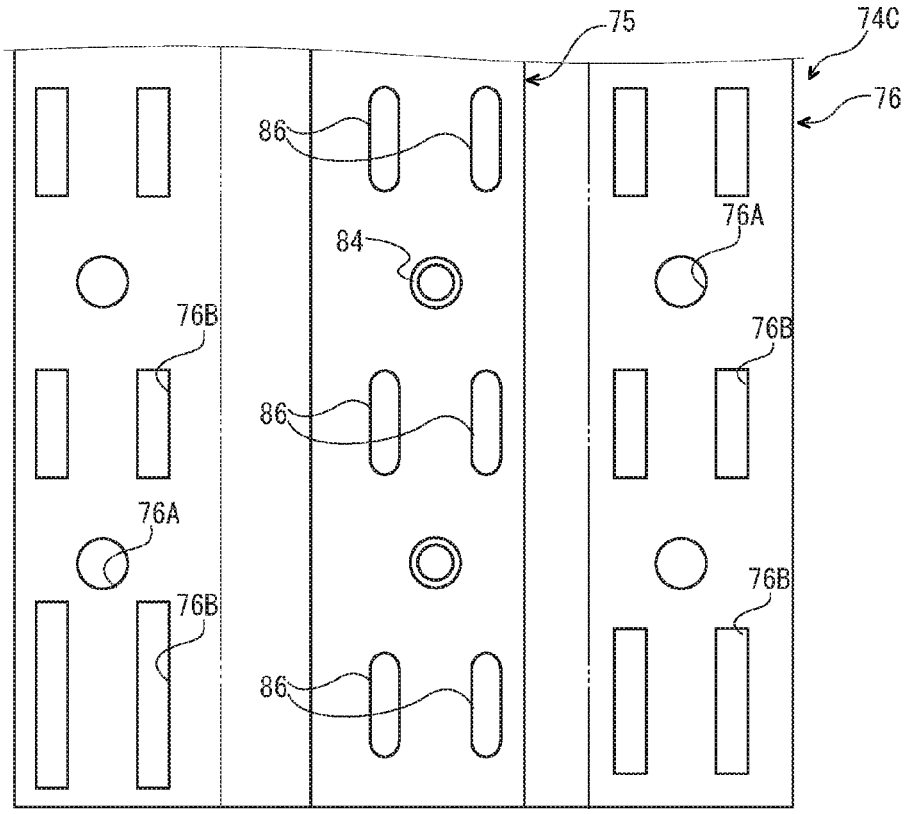
FIG. 9 is a view schematically showing the pressing part according to a third modified embodiment when viewed from the upper side in a state where the sheet member is disposed in natural condition with the sheet member coming into contact with the lower face of the pressing member.
Figure 9:
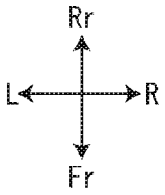

As shown in FIG. 9, in the pressing part 74C of the third modified embodiment, the length in the longitudinal direction of the through hole 76B is gradually increased from the center to the both ends in the longitudinal direction of the pressing part 74C, as well as the first modified embodiment. The third modified embodiment is different from the pressing part 74A of the first modified embodiment in the following point. In the third modified embodiment, the length in the longitudinal direction of each through hole 76B of the upper overlapped side portion of the overlapped side portions of the sheet member 76 on the upper face 82 of the pressing part 74C is longer than that of the lower overlapped side portion.

The upper overlapped side portion of the overlapped side portions of the sheet member 76 on the upper face 82 of the pressing part 74C is heated faster than the lower overlapped side portion because it is near the heat source 72 (or because the light radiated from the heat source 72 and reflected by the heating belt 70 directly arrives).

Thus, according to the third modified embodiment, the upper overlapped side portion of the overlapped side portions of the sheet member 76 on the upper face 82 of the pressing part 74C is hardly teared at the transferring operation, compared with the above described comparative embodiment and the present embodiment. Other effects of the third modified embodiment are the same as the present embodiment, the first and second modified embodiments.

Embodiment

Next, experimental results of the embodiment and comparative embodiment will be described.

Experimental Method

In the present experiment, four kinds of samples of the pressing part 74 (a first to fourth samples) are experimentally formed, each of the four samples is mounted to the fixing device 60 (refer to FIG. 3) according to the present embodiment, the fixing device 60 is attached to the image forming apparatus 10 (refer to FIGS. 1 and 2) and then a continuous printing test is carried out in the following way. The printing is carried out such that a solid image having a density of 5% is formed on an A4 size plain paper as the medium S at 40 PPM (a printing rate of 40 sheets/min). After the printing is continuously subjected to 100 sheets of the plain paper, the pressing part 74 of the fixing device 60 is visually observed. As the result for observing the pressing part 74, a case where at least the end side portions of the sheet member 76 of the pressing part 74 are not teared is defined as good and a case where at least the end side portions are teared is defined as bad.

Sample

Each sample is shown in a table in FIG. 10. In the table of FIG. 10, "center" indicates a position of each projection 86 and each through hole 76B on the center in the longitudinal direction of the pressing part 74, "most end" indicates a position of each projection 86 and each through hole 76B on the most ends in the longitudinal direction of the pressing part 74, and "middle" indicates a middle position between the "center" and the "most end" in the longitudinal direction of the pressing part 74. The first sample is an example of the above described comparative embodiment, and corresponds to a case where a fitting ratio of each through hole 76B with respect to each projection 86 of the pressing part 74 (a ratio of a length in the longitudinal direction of each projection 86 with respect to a length in the longitudinal direction of each through hole 76B) is set to 1. The second sample corresponds to an example of the present embodiment. The third sample corresponds to a modified example of the present embodiment or an example of a modified embodiment of the first modified embodiment. The fourth sample corresponds to an example of the first modified embodiment. As a material of the sheet member 76 in each sample, "TOYOFLON" (trademark), manufactured by TORAY INDUSTRUES, INC. is used.

Experimental Result

As shown in the table of FIG. 10, the first sample (the comparative embodiment) is judged to be bad. On the contrary, the second to fourth samples (the embodiments) are judged to be good. From these results, the applicants are capable of confirming the above described effect of the present embodiment.

As described above, the explanation of the present disclosure is carried out by using the present embodiment as an example. However, the technical scope of the present disclosure is not limited to the present embodiment. For example, the technical scope of the present disclosure may include the following embodiments.

In the explanation of the present embodiment and the modified embodiments, the configurations of the pressing parts 74, 74A, 74B and 74C as examples are described. However, if the above described relationship of the clearance in the sheet member 76 is applied, the pressing parts 74, 74A, 74B and 74C may have configurations different from the above configurations. For example, the above described third sample belongs to the technical scope of the present disclosure because it has the above described relationship of the clearance in the sheet member 76 of the present embodiment.

The present embodiment explains the image forming apparatus 10 as a printer. However, the image forming apparatus 10 is not limited to the printer if it is an electrophotographic type image forming apparatus which forms a toner image on the medium S and then fixes the toner image on the medium S to form an image on the medium S. For example, the image forming apparatus 10 includes an electrophotographic type apparatus such as a multifunctional peripheral and a facsimile machine.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A fixing device comprising:

a heating belt formed to be endless and heating a medium while being circulated;

a heat source supplying heat for heating the medium to the heating belt;

a pressuring body forming a nip with the heating belt, rotating around an axis so as to circulate the heating belt and pressing the medium with the heating belt;

a pressing member disposed inside the heating belt and pressing the heating belt against the pressuring body at the nip, and a heat shrinkable sheet member held between the heating belt and the pressing member and attached to the pressing member at least at a center side portion and both end side portions in a longitudinal direction of the sheet member, the both end side portions being shiftable in the longitudinal direction greater than the center side portion.

2. The fixing device according to claim 1, wherein a plurality of projections are formed on the pressing member, and a plurality of through holes into which the plurality of projections are fitted are formed on the both end side portions and the center side portion of the sheet member, and a clearance in the longitudinal direction of each through hole formed on the both end side portions with respect to each projection is larger than a clearance in the longitudinal direction of each through hole formed on the center side portion with respect to each projection.

3. The fixing device according to claim 2, wherein a length in the longitudinal direction of each through hole formed on the both end side portions is longer than a length in the longitudinal direction of each through hole formed on the center side portion.

4. The fixing device according to claim 2, wherein a length in the longitudinal direction of each projection fitted into each through hole formed on the both end side portions is shorter than a length in the longitudinal direction of each projection fitted into each through hole formed on the center side portion.

5. The fixing device according to claim 2, further comprising:

a supporting member configured to support the pressing member, wherein tip portions of the plurality of projections come in contact with the supporting member.

6. An image forming apparatus comprising:

a fixing device according to claim 1; and a forming part forming an image on the medium to be heated and pressed by the fixing device.

* * * * *